US009714491B2

(12) United States Patent
Wettern

(10) Patent No.: US 9,714,491 B2
(45) Date of Patent: Jul. 25, 2017

(54) CROWD CONTROL BARRIER

(76) Inventor: Laurence Patrick Wettern, Dorset (GB)

( * ) Notice: Subject to any disclaimer, the term of this patent is extended or adjusted under 35 U.S.C. 154(b) by 659 days.

(21) Appl. No.: 14/129,495

(22) PCT Filed: Jun. 8, 2012

(86) PCT No.: PCT/GB2012/051288
§ 371 (c)(1),
(2), (4) Date: Dec. 26, 2013

(87) PCT Pub. No.: WO2012/168719
PCT Pub. Date: Dec. 13, 2012

(65) Prior Publication Data

US 2014/0131500 A1 May 15, 2014

(30) Foreign Application Priority Data

Jun. 8, 2011 (GB) ..... 1109589.0

(51) Int. Cl.
*E01F 13/02* (2006.01)

(52) U.S. Cl.
CPC ..... *E01F 13/022* (2013.01); *E01F 13/028* (2013.01)

(58) Field of Classification Search
CPC ..... E01F 13/02; E01F 13/022; E01F 13/028; E01F 13/04; B65H 75/38; B65H 75/48
See application file for complete search history.

(56) References Cited

U.S. PATENT DOCUMENTS

| | | | | |
|---|---|---|---|---|
| 1,747,081 A | 2/1930 | Reukauf | | |
| 4,844,420 A * | 7/1989 | Oster | B65H 75/38 | 160/24 |
| 6,375,164 B1 * | 4/2002 | Siegler | E01F 13/028 | 256/1 |
| 6,536,502 B2 * | 3/2003 | Britto | E06B 9/08 | 160/23.1 |

(Continued)

FOREIGN PATENT DOCUMENTS

| | | |
|---|---|---|
| DE | 202007008184 | 8/2007 |
| GB | 2346867 | 8/2000 |
| WO | 2009007756 | 1/2009 |

OTHER PUBLICATIONS

International Search Report and Written Opinion for PCT/GB2012/051288 dated Feb. 4, 2013.

*Primary Examiner* — Daniel Wiley
(74) *Attorney, Agent, or Firm* — Andrus Intellectual Property Law, LLP

(57) ABSTRACT

A holder assembly for a crowd control barrier has a bobbin 13 rotatably mounted within a container 12 and configured to have a flexible band 15 wound therearound with the free end 16 of the band emerging from the container whereby the band may be extended so that the free end can be connected to a remote support. When assembled, a spring 25 acts on the bobbin 13 such that tension in the spring is increased as the band 15 is extended whereby the spring may re-wind the band on to the bobbin. The bobbin 13 is axially insertable into and removable from the container 12 to allow the band to be changed. The spring 25 is associated with a carrier 24 and there is a screw-threaded mechanism 27 arranged to rotate the carrier 24 to pre-load the spring 25, as the bobbin 13 is inserted into the container 12.

25 Claims, 10 Drawing Sheets

(56) References Cited

U.S. PATENT DOCUMENTS

| | | | | |
|---|---|---|---|---|
| 6,575,435 | B1 * | 6/2003 | Kotzen | E04H 4/06 160/10 |
| 6,733,204 | B1 * | 5/2004 | Paniccia | E01F 7/06 160/238 |
| 6,776,398 | B1 * | 8/2004 | Tsai | E01F 13/028 256/37 |
| 6,807,999 | B1 * | 10/2004 | Bowen | E01F 13/028 160/24 |
| 7,082,981 | B2 * | 8/2006 | Perez, Jr. | A01K 1/035 160/24 |
| 7,350,480 | B1 * | 4/2008 | Hughes | A01K 3/005 119/512 |
| 7,377,490 | B1 * | 5/2008 | Khosravian | E01F 13/028 119/416 |
| 7,438,112 | B2 * | 10/2008 | Cheng | E01F 13/028 160/24 |
| 7,669,634 | B2 * | 3/2010 | Sugiyama | E06B 9/54 160/206 |
| 7,909,310 | B2 * | 3/2011 | Weiner | E01F 13/028 256/45 |
| 7,971,622 | B2 * | 7/2011 | Trionfetti | E04B 2/7416 160/122 |
| 8,261,806 | B2 * | 9/2012 | Wettern | E01F 13/028 160/24 |
| 9,175,450 | B2 * | 11/2015 | Weiner | E01F 13/028 |
| 2005/0023403 | A1 * | 2/2005 | Lu | B65H 75/4447 242/381.5 |
| 2005/0191107 | A1 * | 9/2005 | Christie | B65H 75/4442 400/208 |
| 2008/0121354 | A1 | 5/2008 | Cheng | |

* cited by examiner

CROWD CONTROL BARRIER

CROSS REFERENCE TO RELATED APPLICATION

The present application is the U.S. national stage of International Application PCT/GB2012/051288, filed Jun. 8, 2012, which international application was published on Dec. 13, 2012, as International Publication No. WO2012/168719. The International Application claims priority to British Patent Application No. GB1109589.0, filed Jun. 8, 2011, the contents of which are incorporated herein reference in their entireties.

This invention relates to various aspects of a crowd control barrier. In particular, this invention relates to a holder assembly for a crowd control barrier in the form of a band extensible from a bobbin located within the assembly, and also to the connection of the band to the bobbin.

A well known form of crowd control barrier has a woven webbing strap or band enclosed within the top part of a vertically-extending post, the strap being wound around a bobbin rotatably mounted within the post. Such barriers have been developed from seatbelt technology where a spring is arranged to provide a rotational moment to the bobbin, to wind the webbing strap back on to the bobbin. The free end of the webbing strap is fitted with a clip so that the webbing strap can be drawn out against the spring force and then attached to a suitable fitting provided either on a similar post or on some other support.

With the known barriers as described above, the webbing strap is usually woven from nylon or polyester and can be decorated either by printing or incorporating the decoration in the weaving. Inevitably, such decoration is of relatively poor quality and must be incorporated within the width of the strap, which typically is about 50 mm. If the decoration is in the form of information or advertising, it would be advantageous to be able to change the webbing strap onsite, but with the present designs this is difficult to achieve and requires dismantling and reassembly of the overall mechanism.

A further problem of the known barriers of the kind described above is that the webbing strap should fully retract (except for an end tab) when the barrier is not in use, but this requires there to be a pre-load in the spring so that when the strap is fully retracted, there is still tension in the spring. This may not be a problem if the strap is not to be changed during its life, for the pre-load can be incorporated within the mechanism during initial assembly. If the barrier is configured to allow the strap to be changed, then it can be very difficult for an operator to ensure there is a sufficient pre-load in the spring for proper operation of the mechanism.

The above problems have been addressed in WO2009/007756, which describes an arrangement where the spring is provided within a cassette. The bobbin is rotatably mounted within the post and the cassette is fitted to the post after the bobbin has been located therein, to apply tension to the bobbin. The arrangement of WO2009/007756 suffers particularly from the limitation that it is very easy for a user accidentally to release the cassette when the strap has been extended. This has the effect of releasing the energy of the spring without any load thereon, which causes the spring to become damaged and be released from its centre mounting. Further, the correct number of pre-tension turns must be applied to the cassette if the barrier is to function as required. These factors mean that significant training is required before someone is able to change the strap successfully, to have the required functionality.

According to a first aspect of this invention, there is provided a holder assembly for a crowd control barrier, the assembly comprising a bobbin rotatably mounted within a container the bobbin being configured to have a flexible band wound therearound with the free end of the band emerging from the container whereby a band wound on the bobbin may be extended to allow the free end of the band to be connected to a remote support, and a spring arranged to act on the bobbin such that tension in the spring is increased as the band is extended, in which assembly the bobbin is axially insertable into and removable from the container, there being a carrier for the spring with one end of the spring acting thereon and the assembly includes screw-thread means arranged so that on the axial insertion of the bobbin into the container, the carrier is rotated to pre-load the spring.

It will be appreciated that the holder assembly of this aspect of the invention typically comprises the upper end portion of a post and within which a bobbin carrying a length of crowd control band is rotatably supported. A spring carrier is provided and is arranged so that on fitting a bobbin carrying a band to the post, the spring carrier is rotated to apply a pre-load to the spring. Conversely, on releasing the bobbin from the post, that pre-load is at least to some extent relieved.

In one embodiment, the carrier is rotatably mounted within the container coaxially with the bobbin and the spring acts between the carrier and the container, the screw-thread means comprising co-operating screw-threads provided on the bobbin and the carrier so that the carrier is rotated on inserting the bobbin into the container, thus tensioning the spring. Advantageously, the carrier is provided with a screw-threaded pin projecting axially therefrom and the bobbin has a correspondingly screw-threaded bore which engages the pin as the bobbin is inserted into the container. The screw threads should be relatively coarse and preferably in the form of helical splines in order that relative rotation will be imparted on relative axial displacement. In the alternative, it would be possible for the carrier to be rotatably mounted on the bobbin and for the spring to act between the carrier and the bobbin. In this case, the co-operating screw threads should be provided on the carrier and the container, so that the carrier is rotated on inserting the bobbin into the container, thus tensioning the spring.

In either case, the screw-thread means could comprise a helically-splined pin or an axially twisted flat bar or strip co-operating with an orifice plate having an opening through which the pin, bar or strip extends so that relative axial movement causes relative rotation. Alternatively, the screw-thread means could comprise a pin carrying at least one laterally-projecting peg which is engageable in a bore having at least one helically-formed groove whereby relative axial movement between the pin and the components having the bore causes relative rotation therebetween.

The container may define a chamber closed at one end with the carrier rotatably mounted within that chamber. A cap may be arranged to close the other end of the chamber opposed to said one end, the cap being removable to allow the bobbin to be removed from and inserted into the chamber. For the preferred embodiment of crowd control barrier, the container may be a part of an upright post, preferably formed at the upper end of that post.

The band wound on the bobbin may comprise a webbing strap as with the known forms of crowd control barrier. Alternatively, the band could take the form of a plastics material film which may have a significantly greater width (i.e. vertical depth, when in use) than the usual form of strap.

According to a second but closely related aspect of this invention there is provided a holder assembly for a crowd control barrier, the assembly comprising a bobbin rotatably mounted within a container and configured to have a flexible band wound therearound with the free end of the band emerging from the container whereby a band wound on the bobbin may be extended to allow the free end of the band to be connected to a remote support, a spring arranged to act on the bobbin such that tension in the spring is increased as the band is extended and a flexible tension member wound around the axis of rotation of the bobbin, in which assembly the flexible tension member is increasingly wound around said axis as tension is released from the spring by rotating the bobbin, the flexible tension member being fully wound tight around said axis before all tension is released from the spring.

The flexible tension member serves to limit the unwinding of the spring, to stop all tension in the spring being released. The flexible tension member becomes fully wound tight around said axis before all tension has been released from the spring on winding the band back on to the bobbin but on pulling the band out of the container, the spring is wound to increase the tension therein and the flexible tension member is unwound.

Preferably, the flexible tension member is in the form of a ribbon or tape connected at one end to the container and at the other end directly or indirectly to the bobbin, such that rotation of the bobbin changes the wound state of the ribbon or tape.

The holder assembly of this aspect of the invention may be incorporated within a holder assembly of this invention as described hereinbefore. In such a case, the flexible tension member may be arranged between the container and the spring carrier such that following complete interengagement of the bobbin with the spring carrier, the flexible tension member is wound or unwound as has been described above.

According to a third aspect of this invention, there is provided a holder assembly for a crowd control barrier, the assembly comprising a bobbin rotatably mounted within a container and configured to have a flexible band wound therearound with the free end of the band emerging from the container whereby a band wound on the bobbin may be extended to allow the free end of the band to be connected to a remote support, a spring arranged to act on the bobbin such that tension in the spring is increased as the band is extended, one end of the bobbin being journalled in a fixed first bearing furnished within the container and the other end of the bobbin being journalled in a second bearing arranged to float transversely within the container.

Preferably, the float of the second bearing is controlled by one or more springs arranged to bias the axis of the second bearing in a direction away from the slot in the container. A force applied to the bobbin by tension on a band unwound from the bobbin may then move the second bearing against the tension of the spring.

This arrangement of the invention allows the accommodation of misalignment between adjacent posts of a barrier system including two or more barriers each having a holder assembly as described hereinbefore. Such an arrangement is useful if the band is much wider than that normally used with a webbing barrier, so as to give a relatively large display area for printing. This generates a problem in that if two adjacent posts are not parallel or are on an uneven floor so that the upper ends of the posts are not on the same level. In such a case, either the top or the bottom of the band may become slack. The provision of springs to control the float of the second bearing may facilitate tension of the band and so make the band as flat as possible. Moreover, the floating second bearing also reduces the likelihood of the bobbin jamming within the holder, on rewinding of the band around the bobbin.

This invention extends to a barrier including a holder assembly as described above in accordance with one of the several aspects of this invention, in combination with a band wound around the bobbin. Preferably, such a band is in the form of a relatively thin film, which may be contrasted with the woven webbing conventionally used for crowd control barriers of this kind. Such a film may be adapted to allow printing to be applied thereto as well as permitting a greater length of film to be wound around the bobbin within a specified container diameter, as compared to a band of woven webbing.

The band, particularly in the case of a film, must be secured to the bobbin in such a way that the film will not be accidentally released from the bobbin on fully unwinding the film. On the other hand, if the film is to be changed in order that when the barrier is deployed to present different information, it should be possible for the old film to be removed from the bobbin and a new film to be secured thereto, without requiring any particular skills.

Taking the above into account, a fourth aspect of this invention provides a crowd control barrier comprising a bobbin rotatably mounted within a container and having a flexible band wound therearound with the free end of the band emerging from the container whereby the band may be extended to allow the free end of the band to be connected to a remote support, the bobbin defining a plurality of slots spaced along the length thereof and the end portion of the band remote from said free end being provided with a plurality of tongues disposed so that each tongue is received in a respective slot, at least some of the slots having a catch projecting across the slot and at least the tongues received in those slots having a respective aperture whereby the tongue is deformed to pass over the catch until the aperture is aligned therewith whereupon the catch enters the aperture to allow the tongue to resume its undeformed configuration and retain the tongue within the slot.

It will be appreciated that the features of the various aspects of this invention may be combined together into a single holder for a barrier or into a barrier including such a holder. Thus, this invention extends to any viable combination of the features of said first aspect of this invention, said second aspect of this invention, said third aspect of this invention and said fourth aspect of this invention.

By way of example only, one specific embodiment of crowd control barrier including various aspects of this invention will now be described in detail, reference being made to the accompanying drawings in which:—

Figures 9A, 9B, 9C:
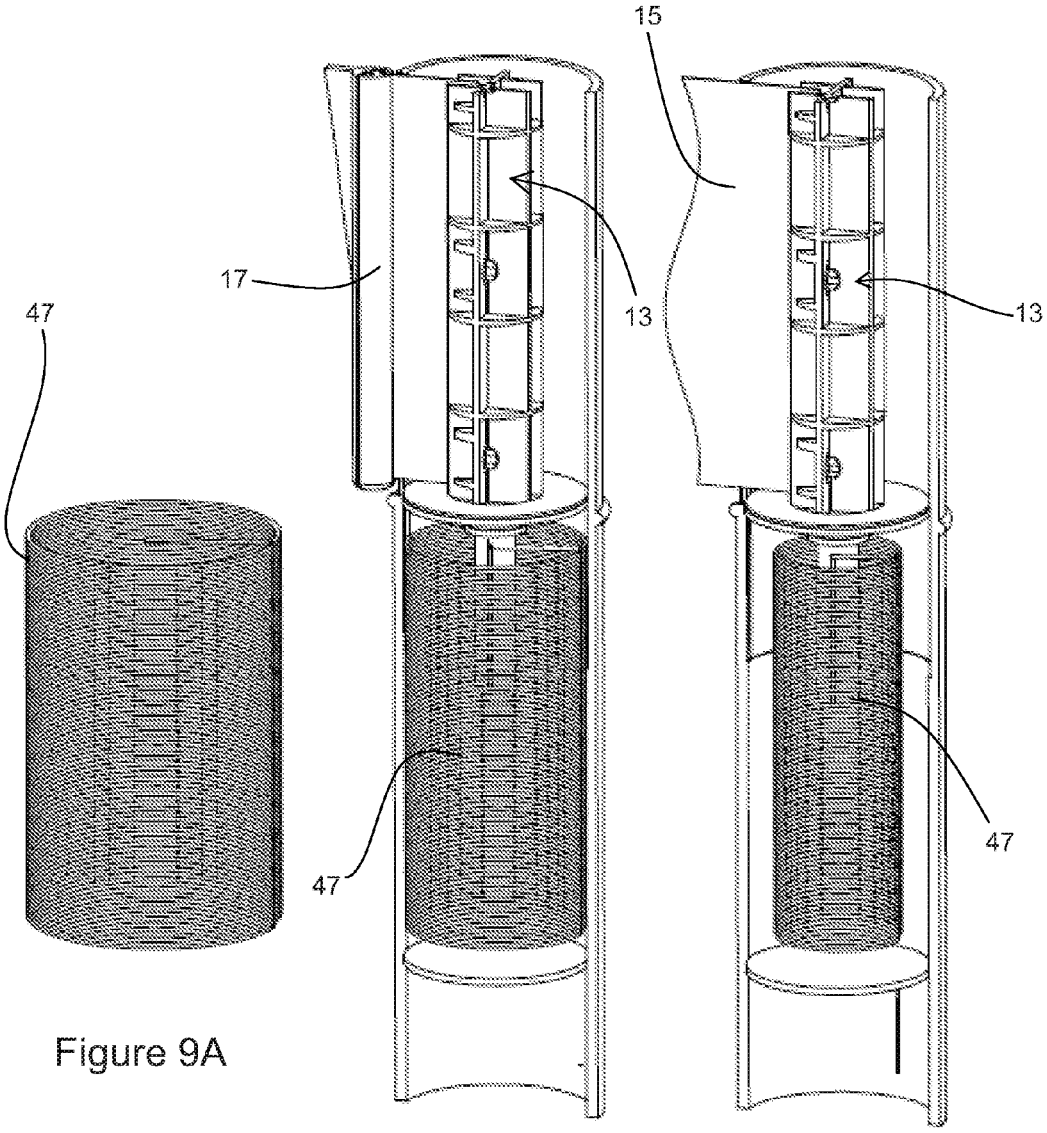
Figure 10:
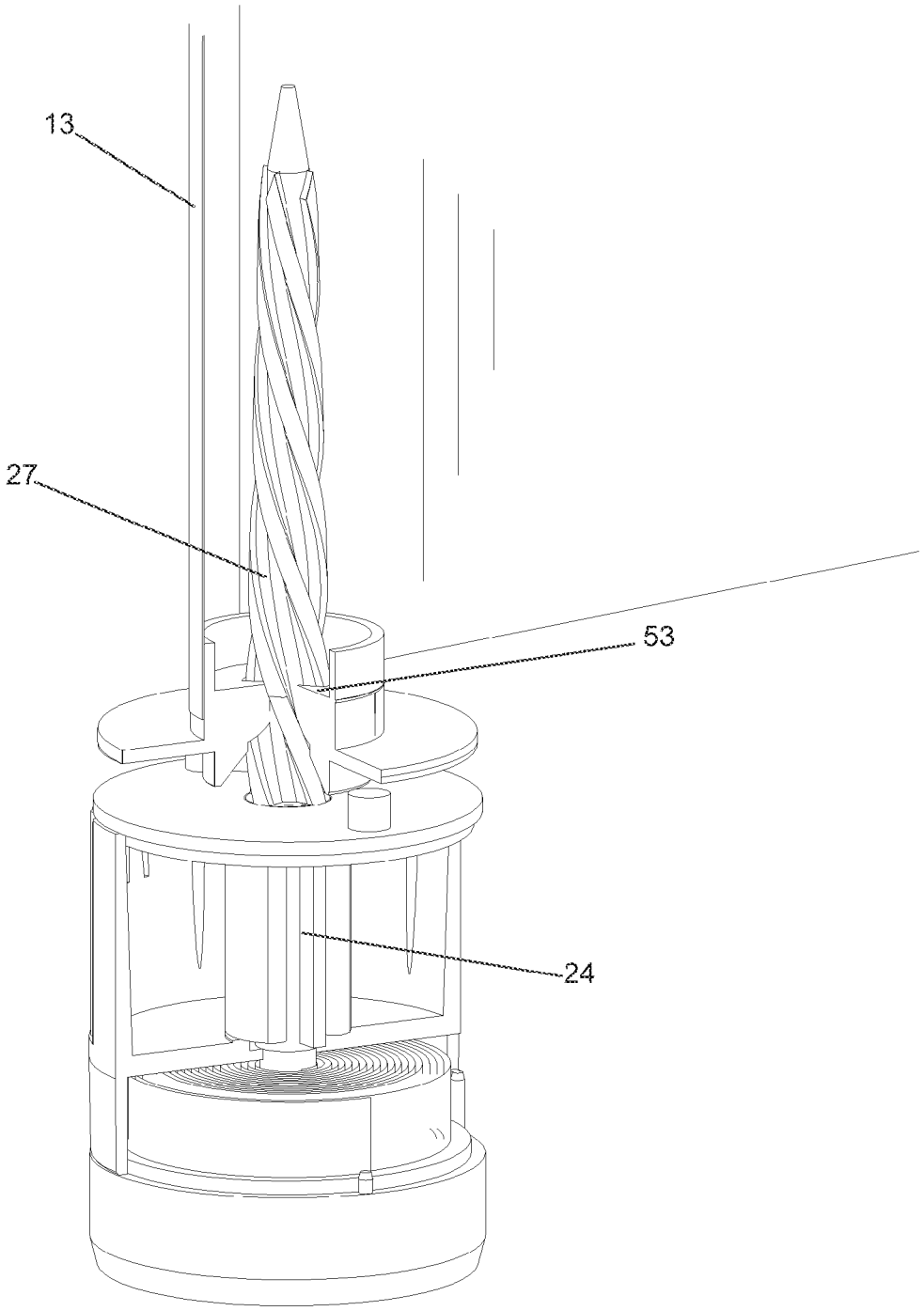

FIGS. 9A, 9B and 9C show an alternative arrangement to that of FIGS. 1 to 5 and utilising a helical coil spring rather than a clock spring to effect rotation of the bobbin, FIG. 9A showing the coil spring in isolation, FIG. 9B the spring in its condition when the band is not extended from the holder assembly, and FIG. 9C the spring in its condition when the band is fully extended from the holder assembly; and FIG. 10 is a detail, partly cut-away view of an embodiment of the bobbin being fitted to the spring carrier.

Figure 1:
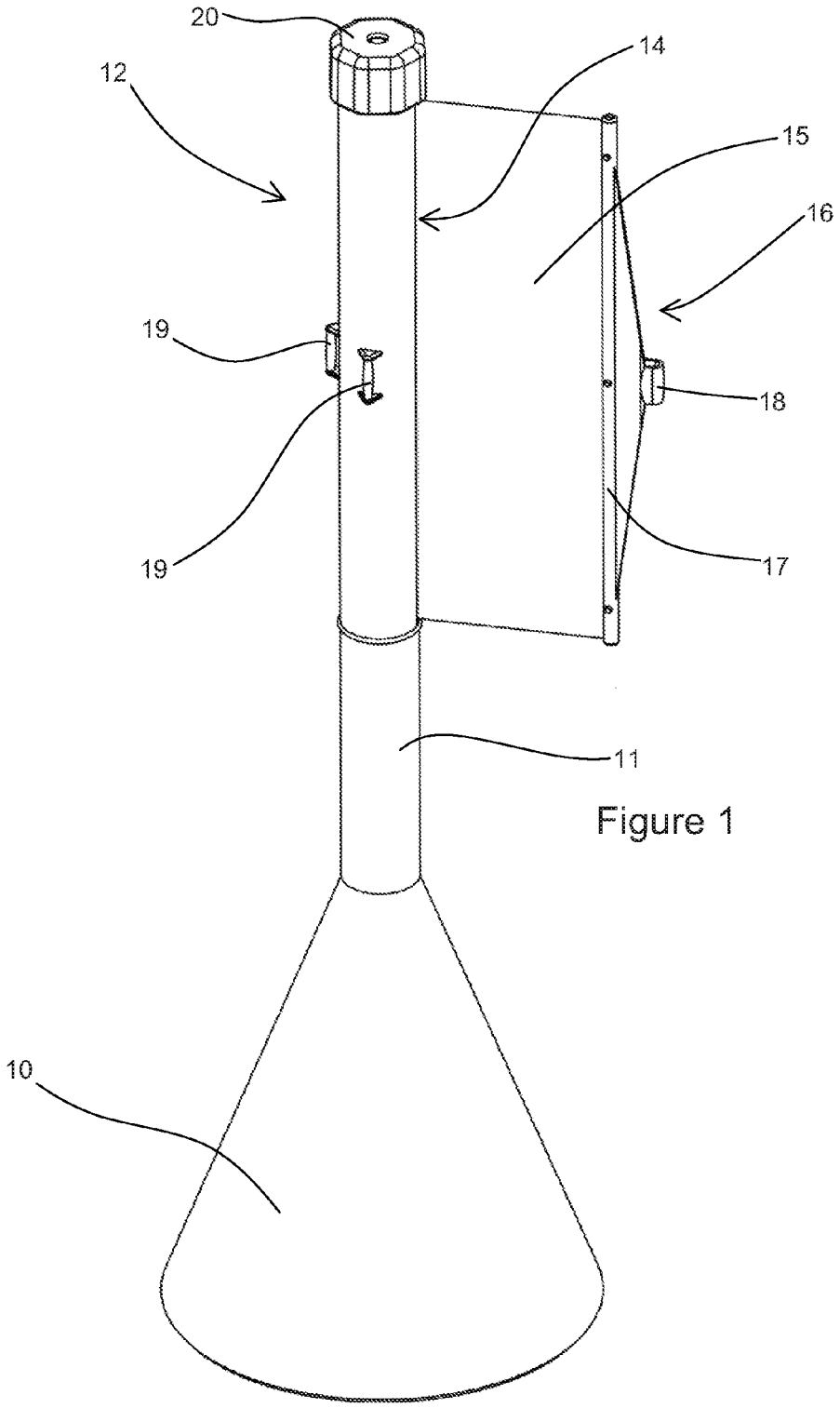
FIG. 1 is a general view of a barrier post including a holder assembly from which a band is extensible.

FIG. 1 is a general view of the embodiment of barrier post including various aspects of this invention. The post comprises a base 10 of general conical form with a tube 11 projecting upwardly from the top of the base 10. The upper region 12 of the tube 11 is configured as a holder assembly for a bobbin 13 (FIG. 2), there being an axial slot 14 formed through the wall of the upper region of the tube and through which a band or film 15 wound on the bobbin 13 may be extended. The free end 16 of the band 15 is secured to a bar 17 including a clip 18 to allow the bar to be connected to some other support, such as another like post. For this purpose, the upper region 12 of the tube is furnished with three retaining lugs 19 spaced therearound and to which the clip 18 of a band from another barrier post may be secured. The open upper end of the upper region 12 of the tube 11 is closed by a cap 20, there being a bayonet-type connection between the cap and the upper end of the tube allowing the cap to be releasably secured thereto. In this embodiment, the band or film 15 has a relatively large width (i.e. vertical depth, in use) as compared to known barriers; the band may have a width of up to 500 mm or even more.

Figure 2:
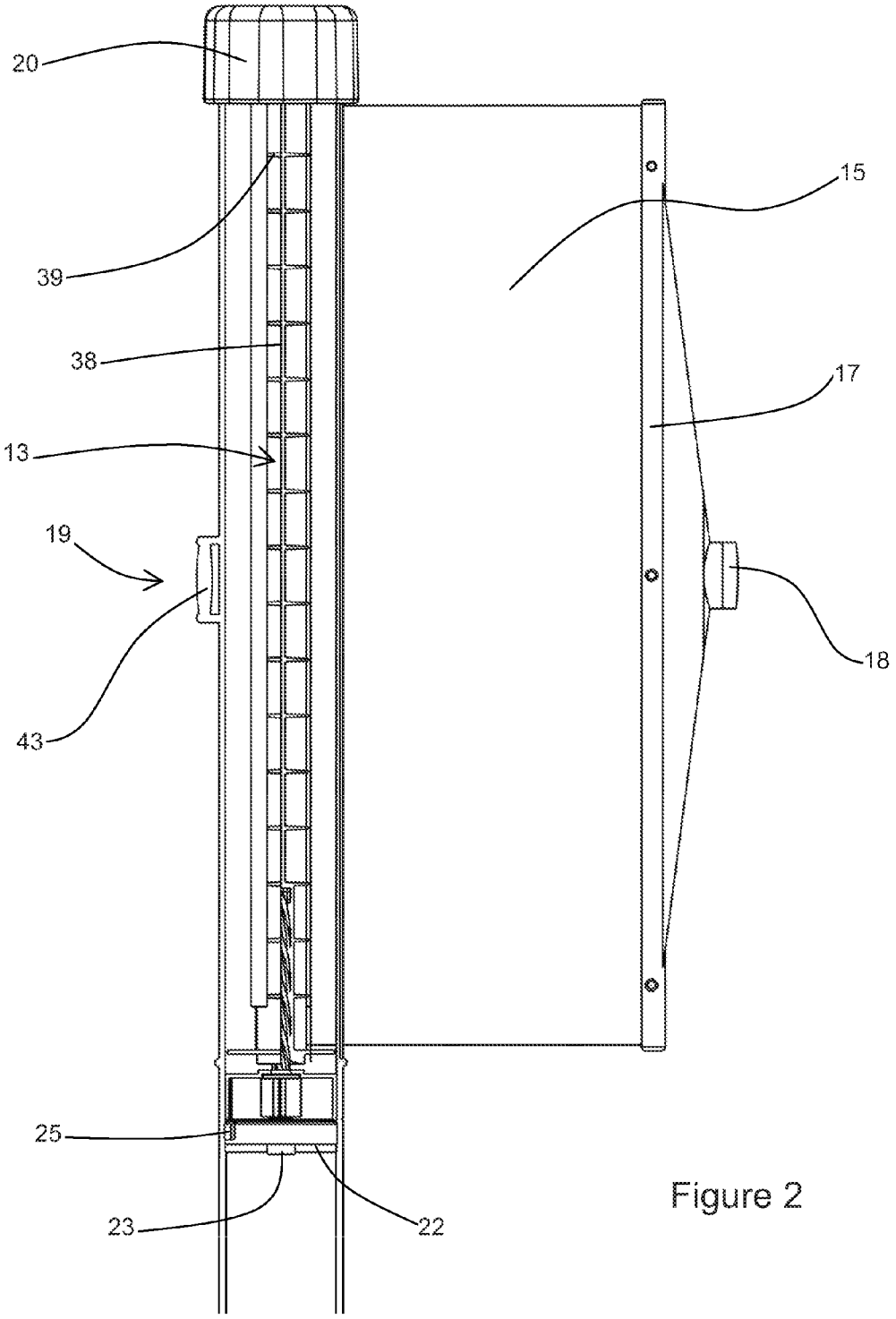
FIG. 2 is a part-sectional side view of the holder assembly and band.
Figure 3:
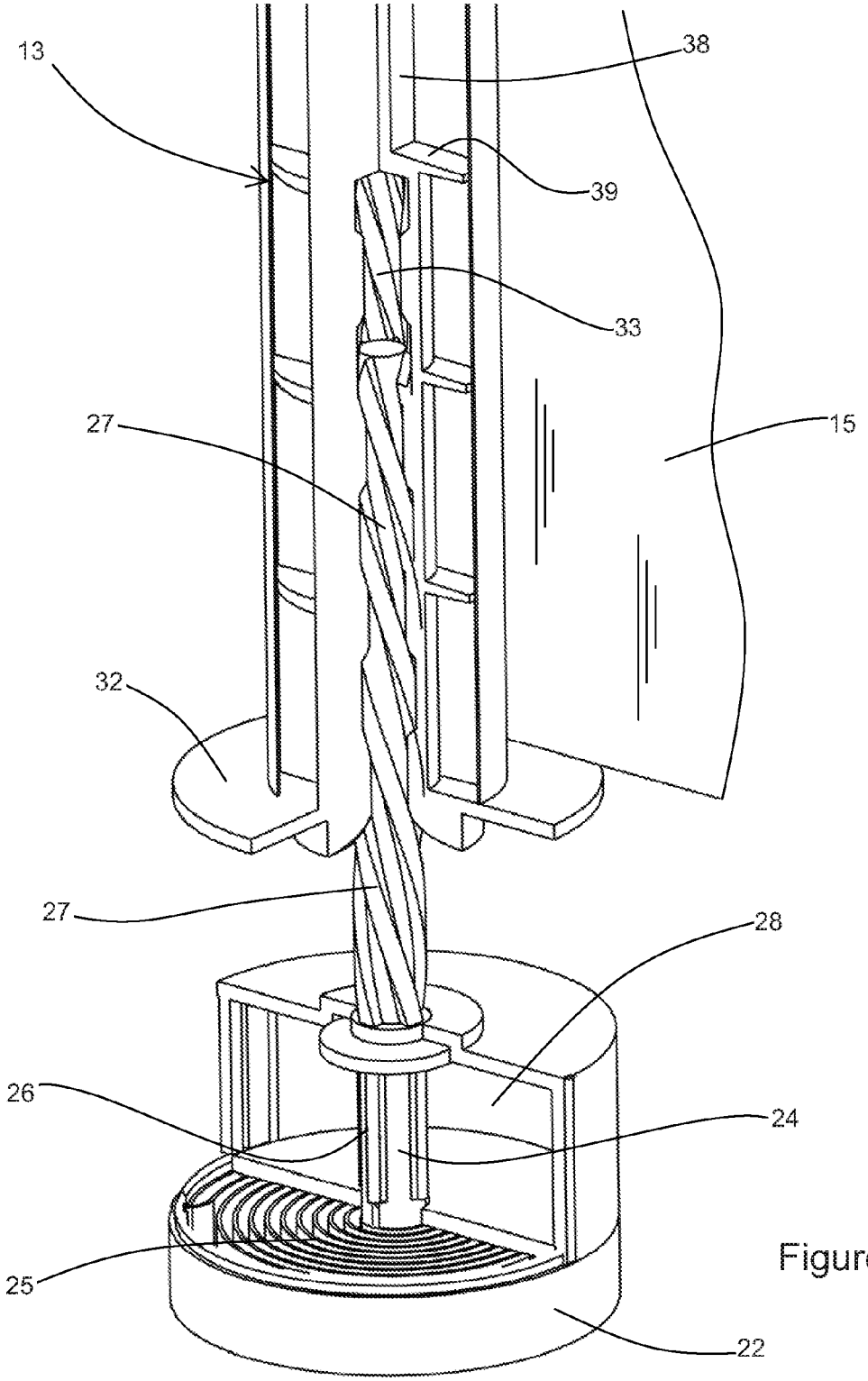
FIG. 3 is a detail view of the bobbin being fitted to a spring carrier, a rotation-limiting tape being removed for clarity.
Figure 4:
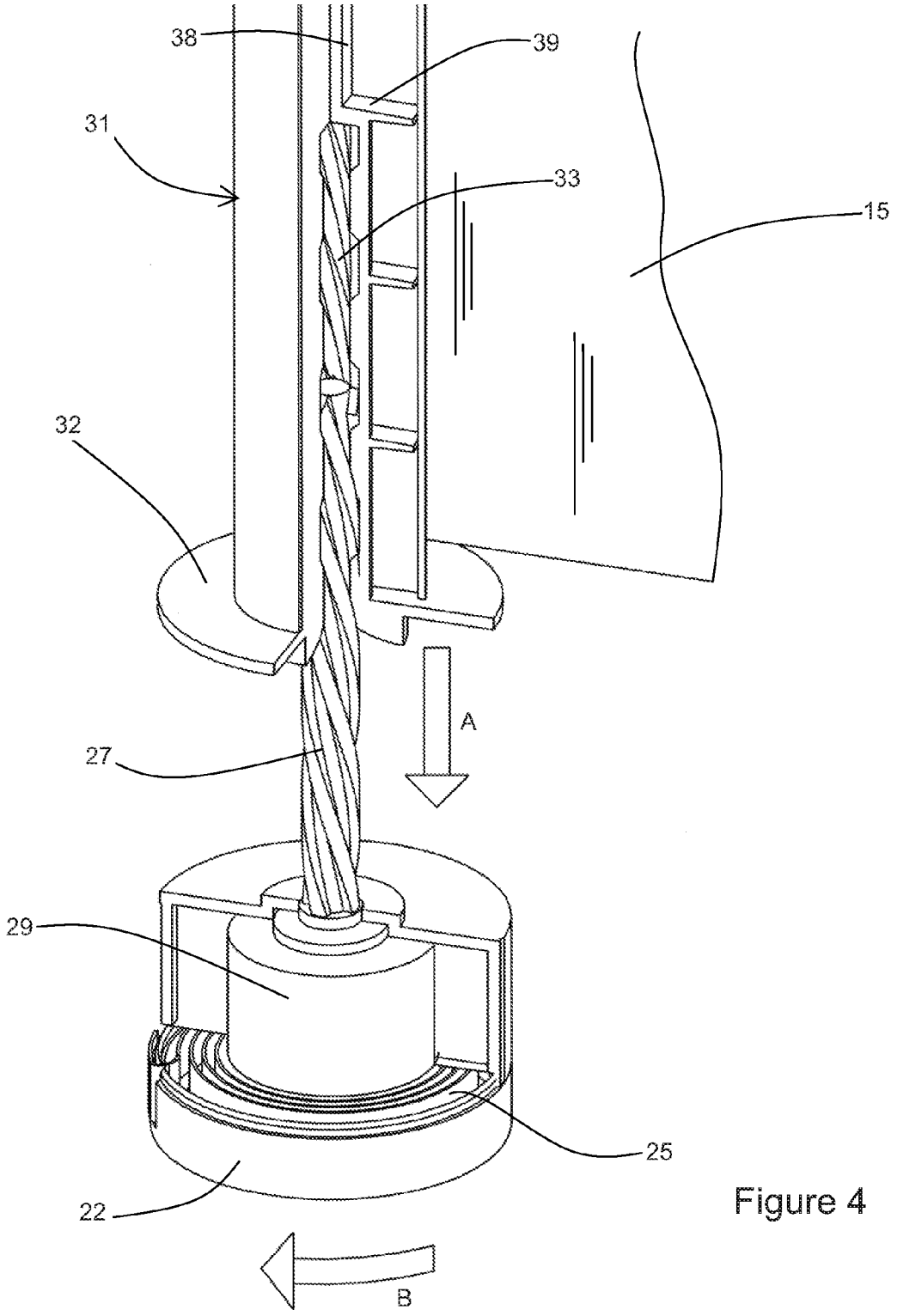
FIG. 4 is a view corresponding to FIG. 3 but with the tape shown.

FIGS. 2 to 4 show various details of the holder assembly at the upper region 12 of the tube 11, and also the bobbin 13 disposed within the holder assembly. At the lower end of the upper region, there is provided an internal transverse wall 22 which provides a bearing 23 for a spring carrier 24. A spiral clock spring 25 has its outer end secured to an upstanding rim of the transverse wall 22, and the inner end to the carrier 24, such that relative rotation of the carrier with respect to the tube 11 increases or decreases the tension in the spring. The carrier is in the form of a pin projecting upwardly along the axis of the tube 11 from the transverse wall 22, the carrier being rotatable with respect thereto but held against axial movement. The carrier has an attachment portion 26 adjacent the spring 25 and a helically-splined portion 27 above the attachment portion. The attachment portion 26 is located within a cylindrical compartment 28 secured to the rim of the transverse wall 22, so that the compartment 28 is held against rotation. A flexible tape 29 is disposed in the compartment 28 and has one end secured to the attachment portion 26 of the carrier 24 and the other end secured to the side wall of compartment 28, and so indirectly to the tube 11. Rotation of the carrier 24 thus changes the tension in the spring 25 and also winds up or unwinds the tape 29 from the carrier, depending on the sense of rotation of the carrier.

The bobbin 13 has a central region 31 and a pair of end cheeks 32, one at each end of the central region. A helically-threaded bore 33 has a complementary form to the helically-splined portion 27 of the carrier, such that axial movement of the bobbin relative to the carrier causes rotation of the carrier, so long as the bobbin is held against rotation during that axial movement. Thus, on fitting the bobbin to the carrier as shown by arrow A in FIG. 4 causes the carrier to rotate as shown by arrow B.

In the initial setting of the carrier 24, spring 25 and tape 29 and with the bobbin 13 removed, there is a small tension in spring 25 but the tape 29 is tightly wound around the attachment portion 26 and so restrains further rotation of the carrier in the sense which would release tension from the spring. Thus, the spring 25 is unwound as far as is permitted by the tape and so remains connected to both the carrier 24 and the rim of transverse wall 22 of the assembly. If now a bobbin 13 having a band 15 fully wound around the central region thereof is pushed down into the tube 11, the helically-splined portion 27 of the carrier enters the bore 33 of the bobbin and so long as the bobbin is held against rotation, the carrier will be turned in the sense which increases the tension in the spring 25 but also unwinds the tape 29. During this action, the band 15 should be passed along slot 14 with the bar 17 on the outside of the tube 11. Once the bobbin is fully inserted into the tube 11, the cap 20 is fitted to the upper end of the tube, engaging the upper end of the bobbin into a bearing within the cap, so as to retain the bobbin therein. A security device may be provided for the cap, to prevent unauthorised removal.

The interaction between the bobbin 13 and carrier 24 ensures there is sufficient tension in the spring 25 rotating the bobbin 13 to maintain the bar 17 bearing against the outer surface of the tube 11, when the band 15 has been released. If the bobbin is to be removed from the tube 11, the cap 20 is released and then, on pulling the bobbin upwardly, the carrier is rotated in the sense which releases tension in the spring until the tape 29 becomes tightly wound around the carrier, whereafter further rotation of the carrier is prevented. This is the initial setting of the components where there is a minimal tension in the spring 25, but sufficient to prevent the ends of the spring disengaging respectively from the carrier 24 and the rim of the transverse wall 22.

Figure 5:
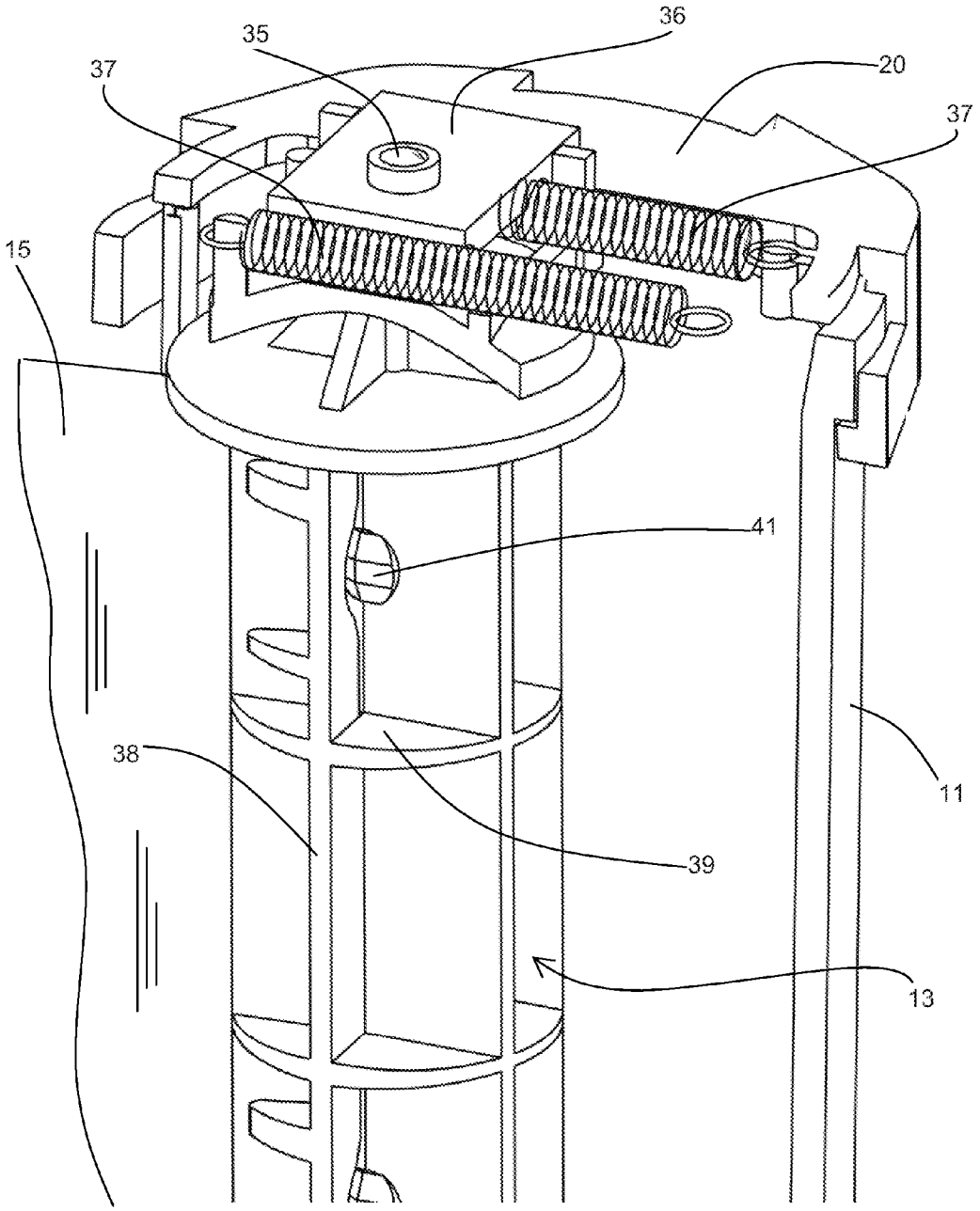
FIG. 5 is a diagrammatic partly cut-away view of the upper region of the holder assembly.

FIG. 5 shows the arrangement within the cap 20 and at the upper end of the bobbin 13. A stub shaft 35 projects axially from the bobbin and is received in a bearing plate 36 supported within the cap 20 by means of springs 37. Within the limits of movement defined by the bore of tube 11, the plate 36 may move laterally while still supporting the bobbin 13. The springs 37 bias the plate 36, and so too the upper end of the bobbin 13, in the direction away from the slot 14 in the tube 11; tension in the upper part of the band 15 may move the plate against the action of the springs 37. This allows the bobbin to align with an off-centre load on the bobbin by the band 15, for example if the band does not extend strictly in a radial direction with respect to the tube 11. This could be in the event that two adjacent posts are not parallel or on the same floor height; then, either the top or bottom of the band could become slack. Particularly when the band is being rewound on the bobbin, allowing movement in this way helps prevent jamming of the bobbin and also ensures uniform winding of the band without creases being formed therein.

Figure 6:
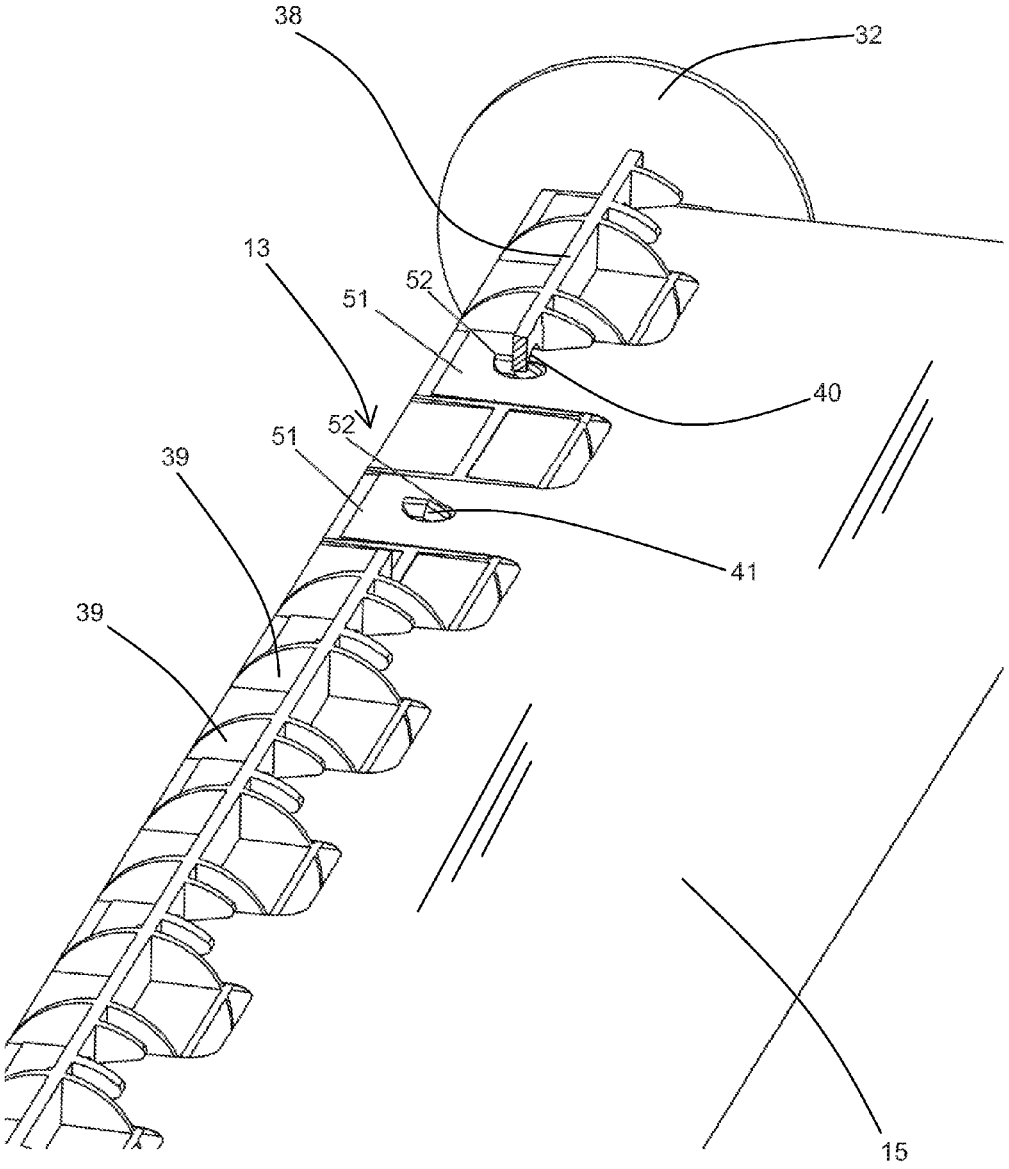
FIG. 6 illustrates the connection of the band to the bobbin.

Referring now particularly to FIG. 6, the attachment of the band 15 to the bobbin 13 is shown in more detail. The central region 31 of the bobbin has a plurality of longitudinal bars 38 extending between the side cheeks 32 and at spaced intervals along the length of those bars there are circular ribs 39 which together with the bars define the cylindrical surface around which the band is wound. Slots 40 are formed in two diametrically opposed bars, between alternate pairs of ribs 39 and projecting from the bar within each slot 40, there is a catch 41. The end of the band is formed with a plurality of tongues 51 configured so that the tongues 51 may be inserted simultaneously into all of the slots 40, the tongues 51 deforming as necessary to pass over the catches 41. Each tongue 51 has an aperture 52 therein so that on a tongue 51 being fully received in a slot, the catch 41 enters that aperture 52 so that the tongue 51 may spring back to its normal flat shape. In this way, the end of the band is securely held to the bobbin but the attachment of the band is very easy to achieve, merely requiring all of the tongues 51 to be pushed through the respective slots 40.

Figure 7:
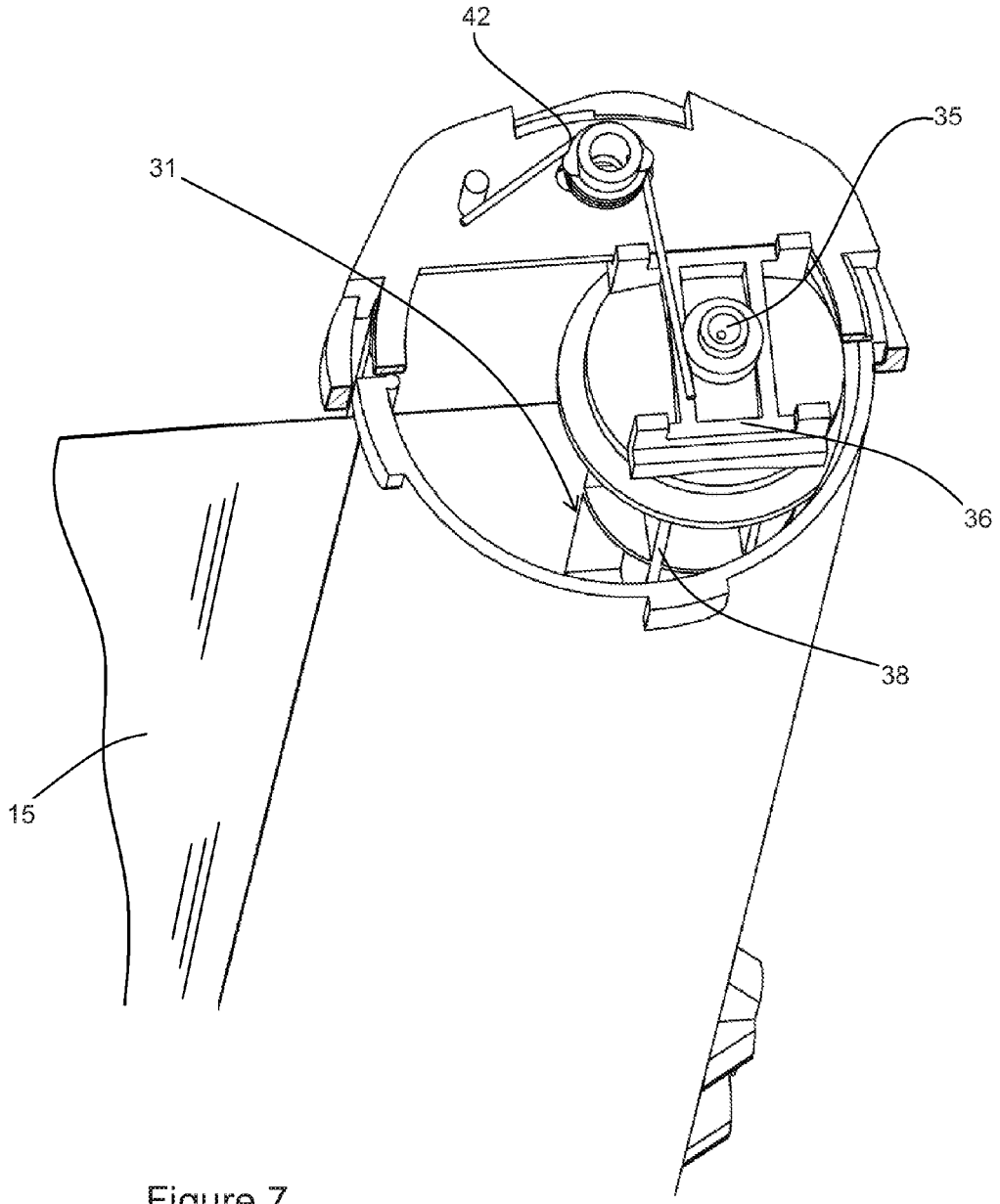
FIG. 7 is a partly cut-away view of an alternative arrangement at the upper region of the holder assembly to that of FIG. 5.

FIG. 7 also shows an alternative arrangement for supporting the upper end of the bobbin 13 within the cap 20. This arrangement employs two opposed torsion springs 42 to bias the bearing plate 36 relative to the cap, rather than the helical springs 37 shown in FIG. 5, but only one such spring 42 is shown in FIG. 7. The bearing plate is allowed to float as required towards or away from the slot 15 by the action of the springs 42. The cap has also been modified to allow accommodation of the springs, but in all other respects, the arrangement of FIG. 7 corresponds to that described above.

Figure 8:
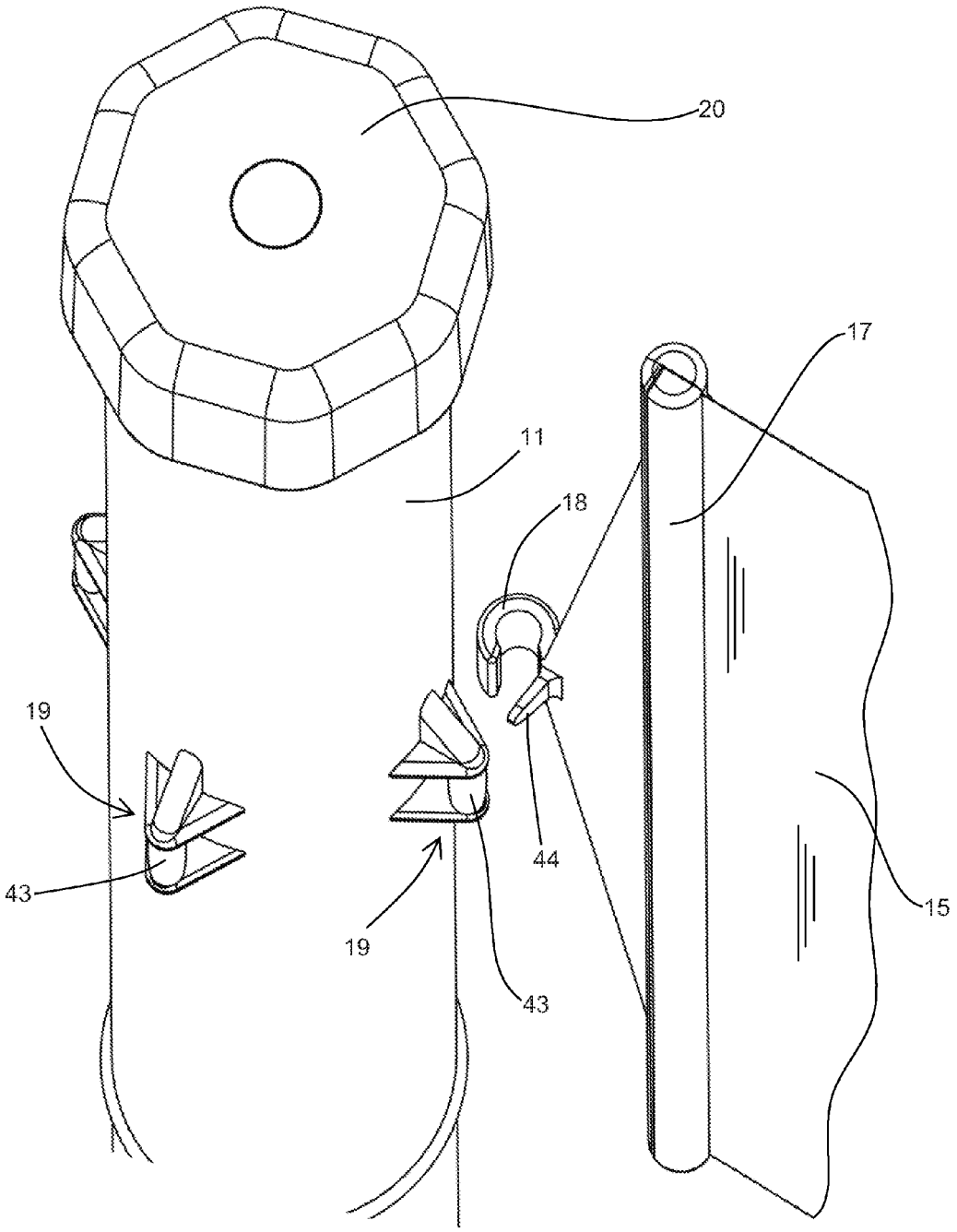
FIG. 8 shows a connection between the free end of the band and a retaining lug for that free end.

FIG. 8 shows the connection of a clip 18 at the free end of the band 15 to a retaining lug 19 of another post. As can be seen, each retaining lug comprises a pair of trunnion plates attached to the outer surface of the tube 11, with a peg 43 extending between the plates. The clip 18 is of re-entrant C-shaped form so that the clip may be snap-fitted to a chosen peg 43. The clip includes a lever 44 which serves both to attach the clip to the free end 16 of the band and also to facilitate the handling of the clip, in performing the connection thereof to a chosen retaining lug 19 and the disconnection of the clip therefrom.

In the embodiment described with reference to FIGS. 2 to 4, drawing the band 15 out of the slot 14 winds up the clock spring 25 so as to increase the tension in that spring. On releasing the free end of the band from a retaining lug 19 the bobbin is turned by the clock spring to wind the band back on the bobbin, the tension in the spring reducing as the winding back continues. In FIG. 9, there is shown an arrangement including a helical coil spring 47 arranged between the transverse wall 22 and the bobbin 13 but which spring 47 is functionally equivalent to the clock spring 25. The coil spring 47 (FIG. 9A) has a greater axial length than the clock spring 25 but by choosing an appropriate number of turns for the spring and an appropriate spring-rate, it would be possible to allow the bobbin to have a greater number of turns of the band 15 wound therearound, without a significant rise in tension in the band consequent upon the winding-up of the spring 47 as the band is drawn off the bobbin. As can be seen by a comparison of FIGS. 9B and 9C, the effective diameter of the spring 47 is reduced as the band is drawn off and turns the bobbin 13, and on the band being rewound on to the bobbin under the force provided by the spring 47, the effective diameter of the spring increases (FIG. 9B).

In the embodiment of FIG. 9, there is no compartment 28 and rotation-limiting tape 29. With a helical coil spring 47, this is unnecessary as the unwinding of the spring is limited by the internal diameter of tube 11. The spring 47 has a relaxed diameter (FIG. 9A) greater than the internal diameter of the tube 11, so that the spring must be wound up to reduce its diameter for insertion into the tube (FIG. 9B). Once the spring has been inserted and is released, the spring will unwind until further unwinding is prevented by the spring bearing on the inner wall of the tube 11 but the spring will in this condition still be wound up to some extent. The lower end of the spring is engaged with a suitable formation in the tube 11 and on inserting a carrier similar to those described above into the tube, the carrier is engaged with the upper end of the spring. The ends of the wire making up the coil spring may appropriately be formed during manufacture to ensure a secure connection with the tube and carrier.

On inserting a bobbin, the carrier will be rotated as described above and the torque from the spring will increase very rapidly as the spring is further wound up and no longer is constrained by the tube (FIG. 9C). On removing the bobbin, the spring will unwind until once more constrained but still will have tension within the spring.

As an alternative to the arrangement described with reference to FIG. 9, it would be possible to use a torsion spring where loading of the spring increases its diameter, the spring initially being provided on a shaft which serves to limit unwinding of the spring. The lower end of the spring may be engaged with the shaft which in turn is non-rotatably fitted into the tube and on rotation of the carrier engaged with the upper end of the spring, by the action of inserting a bobbin, the diameter of the spring will be increased, so increasing the tension in the spring.

In use, a number of barrier posts as shown in FIG. 1 are placed at the required location with a spacing between the posts not exceeding the length of the bands 15 wound around the bobbins 13 within the assemblies at the upper ends of the posts. The bases 10 of the posts may be weighted in order to give stability, but for more permanent installations the posts may be secured to the ground possibly with the elimination of the lower conical regions of the posts. The band is then drawn out of each post and clipped on to the next adjacent post using the clip 18 of one band and a selected retaining lug 19 of the next adjacent post. As the band 15 is drawn out, the spring 25 or 47 associated with the bobbin 13 is wound up, so increasing the tension therein. Subsequently, on disconnecting the clip 18 of a band from a retaining lug 19 allows the band to be rewound on its bobbin, under the force provided by the spring associated with that bobbin.

In the event that a band 15 is damaged and is to be changed, or if a band carries information such as a notification or perhaps advertising and it is desired to change that information, a bobbin 13 carrying the band may easily be removed from the upper region of a post and another bobbin carrying a different band inserted thereinto for subsequent use. This is achieved by releasing the cap 20 at the top of the post and then pulling the bobbin with its band out of the tube 11, sliding the end portion of the band along the slot 14.

As the bobbin is pulled away from the spring carrier 24, relative rotation takes place between the bobbin and the spring carrier by virtue of the interengaged splined portion 27 of the carrier 24 and the correspondingly-threaded bore 33 in the bobbin. This allows the spring to continue unwinding and release tension in the spring though the maximum unwinding rotation of the spring is limited by the tape 29 in the embodiment of FIGS. 1 to 8. Then, on pushing another bobbin into the tube 11 and interengaging the threaded bore 33 in the new bobbin with the splined portion 27 of the carrier 24 while holding the bobbin against rotation, the spring will be pre-loaded by the relative rotation between the bobbin and the spring carrier. Then, the cap 20 is refitted to the tube 11 so that the barrier is ready for use. The pre-load in the spring ensures that when the free end of the band is released, the band is always fully wound back on to the bobbin until the bar 17 engages the tube 11.

FIG. 10 shows an embodiment of the bobbin 13 being fitted to the spring carrier 24. The helically-splined portion 27 of the spring carrier 24 cooperates with an orifice plate 53 of the bobbin 13. The orifice plate 53 has an opening through which the helically-splined portion 27 extends so that relative axial movement causes relative rotation therebetween.

The invention claimed is:

1. A holder assembly for a crowd control barrier, the assembly comprising;

a bobbin rotatably mounted within a container, the bobbin being configured to have a flexible band wound therearound with a free end of said band emerging from the container whereby the band is extensible to allow said free end of said flexible band to be connected to a remote support;

a spring arranged to act on the bobbin such that tension in the spring is increased as the flexible band is extended;

a carrier for the spring, said carrier being rotatably mounted within the container coaxially with the bobbin, and wherein on one end of the spring acts on the carrier and the other end of the spring acts on either the container or the bobbin;

in which assembly the bobbin is axially insertable into and removable from the container, and the assembly includes a screw-thread arrangement comprising interfitting and cooperating screw-threaded components formed on the bobbin and the carrier to effect rotation of the carrier to pre-load the spring on axial insertion of the bobbin into the container.

2. A holder assembly as claimed in claim 1, wherein the spring acts between the carrier and the container.

3. A holder assembly as claimed in claim 2, wherein the carrier is provided with a screw-threaded pin projecting axially therefrom and the bobbin has a correspondingly screw-threaded bore which engages the pin as the bobbin is inserted into the container.

4. A holder assembly as claimed in claim 2, wherein the carrier has a screw-threaded bore and the bobbin is provided with a screw-threaded pin projecting axially therefrom and which engages in the bore as the bobbin is inserted into the container.

5. A holder assembly as claimed in claim 2, wherein the container defines a chamber closed at one end and the carrier is rotatably mounted within the chamber at or adjacent said one end thereof and is restrained against axial movement.

6. A holder assembly as claimed in claim 1, wherein the spring acts between the carrier and the bobbin.

7. A holder assembly as claimed in claim 6, wherein the carrier is provided with a screw-threaded pin projecting axially therefrom and the container has a correspondingly screw-threaded bore in which the pin is threadingly engaged as the bobbin is inserted into the container.

8. A holder assembly as claimed in claim 6, wherein the carrier has a screw-threaded bore and the container is provided with a projecting screw-threaded pin which is threadingly received in the carrier bore as the bobbin is inserted into the container.

9. A holder assembly as claimed in claim 6, wherein the container defines a chamber closed at one end and the carrier is rotatably mounted on the bobbin at the end thereof which lies adjacent said closed end when the bobbin has been inserted into the chamber.

10. A holder assembly as claimed in claim 1, wherein the screw-thread arrangement comprises one of a helically-splined pin, an axially-twisted bar and a strip co-operating with an orifice plate having an opening through which the pin, bar or strip extends so that relative axial movement causes relative rotation therebetween.

11. A holder assembly as claimed in claim 1, wherein the screw-thread arrangement comprises a pin carrying at least one laterally-projecting peg which is engageable in a bore having at least one helically-formed groove so that relative axial movement causes relative rotation between the pin and the groove.

12. A holder assembly as claimed in claim 1, further comprising a flexible tension member wound around an axis of rotation of the bobbin, in which assembly the flexible tension member is increasingly wound around said axis as tension is released from the spring by rotating the bobbin, the flexible tension member being fully wound tight around said axis before all tension is released from the spring.

13. A holder assembly as claimed in claim 12, wherein the flexible tension member comprises a tape or ribbon which is unwound as the bobbin turns to increase the tension in the spring.

14. A holder assembly as claimed in claim 12, wherein the container has an open end out of which the bobbin may be removed from the container, the flexible tension member being located within a separate compartment formed within the container at an end thereof remote from said open end.

15. A holder assembly as claimed in claim 12 wherein one end of the bobbin is journalled in a fixed first bearing furnished within the container and the other end of the bobbin is journalled in a second bearing arranged to float transversely within the container.

16. A holder assembly as claimed in claim 12, wherein the bobbin defines a plurality of slots spaced along the length thereof and the end portion of the band remote from said free end is provided with a plurality of tongues disposed so that each tongue is received in a respective slot, at least some of the slots having a catch projecting across the slot and at least the tongues received in said slots having a respective aperture whereby the tongue is deformed to pass over the catch until the aperture is aligned therewith whereupon the catch enters the aperture to allow the tongue to resume its undeformed configuration and retain the tongue within the slot.

17. A holder assembly as claimed in claim 1, wherein one end of the bobbin is journalled in a fixed first bearing furnished within the container and the other end of the bobbin is journalled in a second bearing arranged to float transversely within the container.

18. A holder assembly as claimed in claim 17, wherein the container is closed at one end and the other end opposed to said one end is open, to allow the bobbin to be inserted into and removed from the container.

19. A holder assembly as claimed in claim 18, wherein the container is provided with a removable cap to close the other end of the container opposed to said one end.

20. A holder assembly as claimed in claim 19, wherein the other end of the container and the cap are provided either with co-operating screw threads or with a bayonet connector to allow releasable attachment of the cap to the container.

21. A holder assembly as claimed in claim 17 and provided with a removable cap at an open end thereof, wherein the second bearing is formed in a plate arranged to float within said cap for the other end of the container.

22. A holder assembly as claimed in claim 21, wherein the plate is spring-urged towards a side of the container opposed to the side from which the band emerges.

23. A holder assembly as claimed in claim 17, wherein the bobbin defines a plurality of slots spaced along the length thereof and the end portion of the band remote from said free end is provided with a plurality of tongues disposed so that each tongue is received in a respective slot, at least some of the slots having a catch projecting across the slot and at least the tongues received in said slots having a respective aperture whereby the tongue is deformed to pass over the catch until the aperture is aligned therewith whereupon the catch enters the aperture to allow the tongue to resume its undeformed configuration and retain the tongue within the slot.

24. A holder assembly as claimed in claim 1, wherein the spring acting on the bobbin comprises one of a helically-wound torsion spring and a spirally-wound clock spring.

25. A holder assembly as claimed in claim 1, wherein the bobbin defines a plurality of slots spaced along the length thereof and the end portion of the band remote from said free end is provided with a plurality of tongues disposed so that each tongue is received in a respective slot, at least some of the slots having a catch projecting across the slot and at least the tongues received in said slots having a respective aperture whereby the tongue is deformed to pass over the catch until the aperture is aligned therewith whereupon the catch enters the aperture to allow the tongue to resume its undeformed configuration and retain the tongue within the slot.

* * * * *